US005829530A

United States Patent [19]

Nolen

[11] Patent Number: 5,829,530

[45] Date of Patent: Nov. 3, 1998

[54] PUMP OFF CONTROL USING FLUID LEVELS

[76] Inventor: Kenneth B. Nolen, 3507 Cardinal La., Midland, Tex. 79707

[21] Appl. No.: 958,175

[22] Filed: Oct. 27, 1997

Related U.S. Application Data

[62] Division of Ser. No. 571,412, Dec. 13, 1995, Pat. No. 5,715,890.

[51] Int. Cl.[6] ..... E21B 43/00; E21B 47/04

[52] U.S. Cl. ..... 166/369; 166/53

[58] Field of Search ..... 166/369, 53, 250.03

[56] References Cited

U.S. PATENT DOCUMENTS

| | | | |
|---|---|---|---|
| 2,560,911 | 7/1951 | Wolf | 367/908 |
| 3,965,983 | 6/1976 | Watson | 166/369 |
| 4,125,163 | 11/1978 | Fitzpatrick | 166/53 |
| 4,391,135 | 7/1983 | Godbey et al. | 73/155 |
| 4,570,718 | 2/1986 | Adams, Jr. | 166/369 |
| 4,793,178 | 12/1988 | Ahern et al. | 73/151 |
| 4,934,186 | 6/1990 | McCoy | 73/151 |
| 5,117,399 | 5/1992 | McCoy et al. | 367/99 |
| 5,146,991 | 9/1992 | Rogers, Jr. | 166/369 |

*Primary Examiner*—Hoang C. Dang

[57] ABSTRACT

An acoustic method is disclosed for performing pump off control using fluid level in producing wells and other inaccessible cavities. The method uses flow induced pressure phenomena to locate the fluid level. Simplified equipment is involved and acoustic velocities can be measured externally from the well. The method applies to various artificial lift methods in which a conduit is accessible for measuring fluid level.

4 Claims, 2 Drawing Sheets

PUMP OFF CONTROL USING FLUID LEVELS

This application is a division of patent application Ser. No. 08/571,412. Filed Dec. 13, 1995 by Kenneth B. Nolen entitled Determining Fluid Levels In Wells With Flow Induced Pressure Pulses. Now U.S. Pat. No. 5,715,890.

BACKGROUND OF THE INVENTION

Knowledge of reservoir pressure is important in the production of oil wells. When this pressure is high enough, fluids from the reservoir are pushed to the surface with energy supplied by the reservoir alone. In this case the well is said to be a 'flowing well'. But when this pressure diminishes, artificial lift equipment must be installed to raise fluid to the surface. The depth from which the fluid must be lifted is directly related to reservoir pressure and affects the size of lift equipment required. Fluid level is also an important parameter in determining the maximum production capability of a well. If fluid is pushed by reservoir pressure to a level near the surface, little additional lifting energy must be supplied by pumping equipment. Also a fluid level near the surface indicates a well with high reservoir pressure which is capable of more production if pumped more aggressively. If, on the other hand, reservoir pressure is low and the fluid level is far below the surface, the pumping equipment will have to supply most of the lifting energy. The low reservoir pressure and the related deep fluid level means that the well is producing near its capacity. The end point is reached when reservoir pressure is so low that the fluid level is virtually at downhole pump depth. In this case the well would be producing at its maximum rate at that pump depth. It would be termed as 'pumped off'.

The foregoing discussion reveals that measurement of the fluid level in a well is an important activity in determining the size of lift equipment required and in determining the well's productive capability. The fluid level can be expressed 1) as the distance downward from the surface or 2) as the fluid submergence above the reservoir or downhole pump.

Measurement of fluid level has been accomplished by acoustic means for many years. Well casing is set to reach or penetrate a productive reservoir and segmented production tubing is run inside of the casing. The tubing contains a downhole pump whose purpose is to lift fluid (oil, water and gas) to the surface. Depending upon the type of downhole pump in use, energy can be supplied by means of sucker rods or by electrical conductors or by pressurized fluid, among others. The segmented tubing is joined with screw connections which are larger than the outside diameter of the tubing. These form small obstructions to acoustic phenomena traveling in the casing—tubing annulus.

To measure the fluid level acoustically, a noise is induced in the casing at the surface. The sound is usually created by discharging gunpowder or by releasing pressurized gas such as carbon dioxide or nitrogen into the casing. The initial 'blast' and subsequent echos are sensed by microphone and amplification equipment. These signals are then recorded versus time on a fast running strip chart plotting device. The sound disturbance travels downward in the casing until it reaches the top of the fluid column in the casing-tubing annulus. Thereafter the sound disturbance reflects upward to the surface where its arrival is recorded by the strip chart device. The round trip time T (measured from the initial blast to the top of fluid thence to the surface again) is used to calculate the distance from the surface to the fluid by means of the formula $$H=0.5\ V\ T \qquad \ldots 1$$

where

H=distance from the surface to the fluid top, ft

V=velocity of sound in the gaseous medium filling the casing above the fluid level, ft/sec T=round trip time (from the initial blast to the top of fluid thence to the surface again), sec.

A variety of ways for determining the velocity of sound are known to those familiar with the art of measuring fluid levels, such as 1. Inferring velocity from the rate at which echos are received from connections in the segmented tubing. The distance (or at least the average distance) between connections, i.e. tubing joint length, is known and the velocity of sound can be calculated. This is the most commonly used method.
2. Using theoretical relationships between velocity, pressure, temperature and gas composition.
3. Inferring velocity from the measured round trip time to a downhole obstruction the depth of which is known and whose echo can be identified in the record.

In shallower wells it is sometimes possible to sense echos of tubing connections continuously from the surface to the fluid level. The fluid level can then be determined without measuring velocity according to the simple formula $$H=N\ L_a \qquad \ldots 2$$

where

H=distance from the surface to the fluid top, ft

N=total number of tubing joints counted from initial blast to fluid level echo $L_a$=average length of the segmented tubing joints, ft.

In deeper wells and in wells in which 'hearing' is poor, it is usually not possible to receive echos from every tubing connection from the surface to the fluid level. In these cases, the velocity is inferred using echos from the shallower tubing connections which are still discernable and equation 1 is used to calculate the depth to fluid. If desired, the explicit calculation of velocity in equation 1 can be avoided by using equation 3 below. The number of connection echos per inch on the paper recording (while the echos are discernable) is measured and this echo rate is applied to the number of inches on the chart representing the time between the initial blast and the fluid level echo. This is expressed in the formula $$H=R\ L_a\ D \qquad \ldots 3$$

where

H=distance from the surface to the fluid top, ft

R=number of tubing connection echos per inch on the chart paper, joints/inch $L_a$=average length of the segmented tubing joints, ft D=measured distance (on the chart paper) between the initial blast and the fluid level echo, inches.

In recent years, microcomputers have been used to collect, compute and display fluid level information. The computer is used to record and display the echos instead of the paper chart device. The methods of finding fluid level are the same as used in the older methods, but the techniques are merely implemented with the computer.

Existing technology, either traditional or digital, has certain aspects in need of improvement.

i) Creation of the noise in the casing in the usual way has inherent disadvantages. This is because the faint echos from tubing connections tend to be lost in the noisy initial blast. The initial blast has a complex character. Consequently, it is necessary to use filtering techniques (either electronically with the traditional equipment or digitally with computer based equipment) in order to discern the faint echos in the noisy background caused by the initial blast.

ii) Inherent errors exist when theoretical relationships are used to compute the velocity of sound in the gaseous medium.

iii) The sensitive microphone and recording equipment tend to be delicate and costly.

iv) Determination of tubing joint length can introduce error. Ideally the tubing joints are measured (tallied) before running into the well. But this is not always done and the average joint length is often estimated. Range 2 tubing allows a variation in length from 28 to 32 feet and this can introduce a large error. Also the tubing joints, even when tallied, may be run at random and this too introduces error.

SUMMARY OF THE INVENTION

The present invention simplifies the process of obtaining a fluid level measurement. Instead of creating a noise in the casing to produce echos from the fluid top, a pressure disturbance is caused by quickly venting a small quantity of casing gas to the atmosphere. This venting is done rapidly such that the amount of gas emitted is small and not harmful to the environment or to operating personnel. In fact the venting usually occurs in less than 0.5 second. In addition to safety and environmental considerations, the brief duration is desirable because it provides a sharper wave front on the pressure pulse that reflects off the top of the fluid. The sharper front improves accuracy in timing the arrival of the reflected signal. The pressure disturbance so created is simple in wave form (in this writing, wave form is thought of as the relationship of gas pressure versus time during the measurement process). In contrast, the sound created in the traditional way (with gunpowder or release of pressurized gas) is complex (constituted from high frequencies) and receipt of echos is more difficult. Also the simple wave form created by rapid venting in the present invention allows use of relatively simple and inexpensive pressure sensing equipment.

Another distinctive feature of the present invention concerns measurement of sound velocity. No need exists to evaluate velocity by sensing minute echos from tubing connections as in the traditional methods. Instead this velocity is literally measured in a short length of small diameter coiled tubing external to the well. Actual gas from the casing is allowed to flow into the coiled tubing thereby displacing gas remaining from the last measurement. The gas temperature and pressure are noted and a tiny amount of gas is allowed to escape at one end of the coiled tubing. The rarefaction pressure wave so created travels to the other end of the tube and reflects back to the starting point. Using a pressure transducer and a fast running analog to digital converter, the round trip time is measured and applied to the known length of coiled tubing to calculate the sound velocity. This process is completely analogous to the process of measuring fluid level in the well itself. The sound velocity so measured in the coiled tubing is adjusted to the temperature and pressure of the gas in the well itself and used with equation 1 to determine fluid level. Measuring sound velocity in the coiled tubing can be quickly done and is easily comprehended by users of the method. What is unexpected is the accuracy with which the velocity can be determined in such a short length of tubing. By keeping the tubing length short and by coiling it, the apparatus can be light and portable.

The entire process can be automated and computer controlled by using electrically operated valves to vent the gas. Alternately the gas can be emitted by a quick operating mechanical valve disclosed in this invention.

The present invention also lends itself to pump off control of a well. The fluid level measurement process can be implemented repetitively under timer or computer control. When fluid level reaches a specified depth, the pumping unit can be caused to 1) stop or 2) to slow down or 3) to pump more aggressively. Stopping or slowing down allows more fluid to enter the wellbore from the reservoir. Energy is saved and wear and tear on the pumping equipment is diminished. Conversely a fluid level too close to the surface can be used to signal the pumping equipment to continue pumping or even to pump more aggressively. This would increase production hence revenue from the well.

Yet another application of the present invention pertains to evaluation of reservoir productivity. The rate at which reservoir pressure changes when producing rates are changed is indicative of reservoir size, damage to inflow capability near the wellbore and maximum pressure attained in the wellbore after production is halted. The fluid level measurement process can be implemented repetitively under timer or computer control. The invention can be made to compute and remember fluid levels taken systematically versus time as the well pressure adjusts to changing production rates. Reservoir engineers schooled in the manipulation of such data can then draw useful conclusions about the well's potential to produce, ultimate recovery and possible damage near the wellbore.

BRIEF DESCRIPTION OF THE DRAWINGS

The present invention will be more easily understood when described in conjunction with the drawings in which.

DESCRIPTION OF A PREFERRED EMBODIMENT

Figure 2:
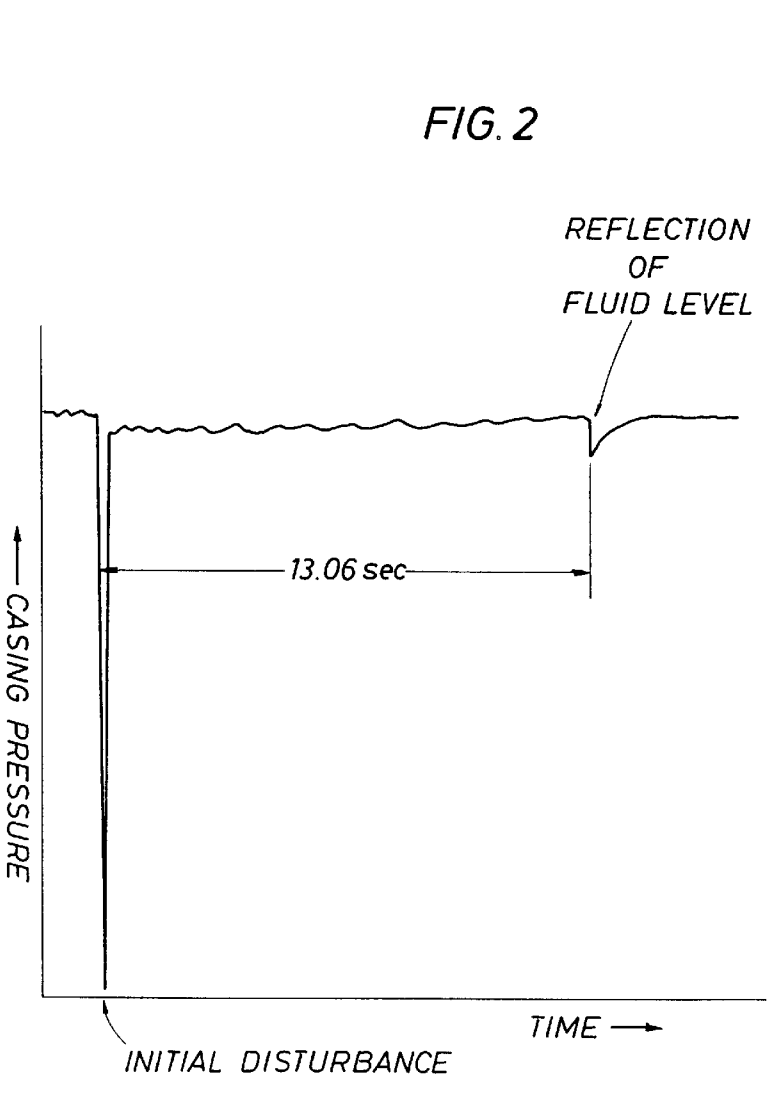
FIG. 2 is a measurement of pressure versus time showing the initial pressure disturbance caused by venting gas and the reflection of that disturbance off the top of the fluid.
Figure 1:
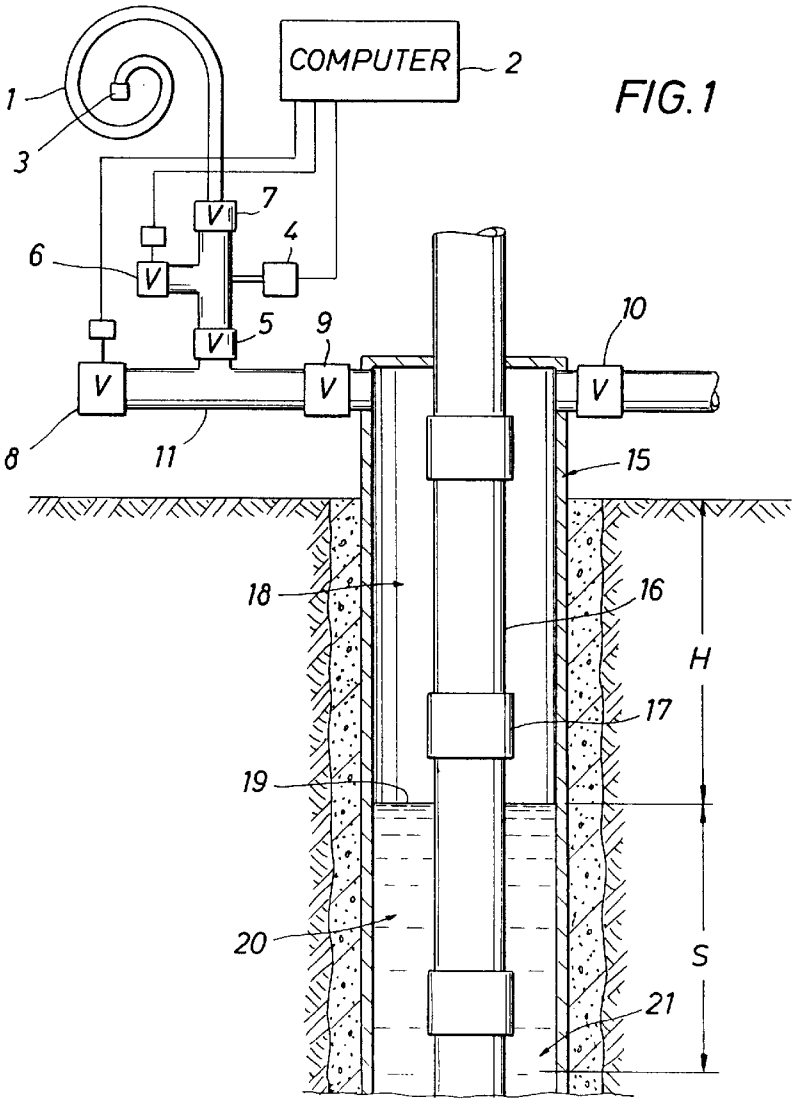
FIG. 1 is an elevation view of a borehole showing downhole tubulars and the apparatus of the present invention.

Referring now to FIG. 1, there is shown the apparatus of the present invention installed on a well. Casing 15 penetrates a productive reservoir 21. Inside of the casing segmented well production tubing 16 is shown with screwed connections or collars 17. Reservoir pressure has caused fluid 20 to stand in the casing to a level 19 which is a distance H from the surface or a distance S above a reservoir datum. Above the fluid is hydrocarbon or other gas 18 which is flowing to the surface for sale or other purposes. Particularly in this invention, the gas provides the medium which transmits pressure waves important in determining fluid level. During routine production operations, valve 10 is open which allows collection of the gas at the surface for recovery and/or sale.

The apparatus pertinent to this invention attaches to the casing downstream of valve 9 installed in an auxiliary line 11. Valve 8 is an electrically or manually operated valve for emitting gas from the casing and creating the pressure disturbance for measuring fluid level. Valve 8 could be for example a 1 inch pilot operated solenoid valve number 73212BN63N00N0C111C1 manufactured by Honeywell/Skinner Co. of New Britain, Conn. The pressure transducer, analog to digital converter, amplifier and related electronics 4 are connected to the computer 2 which collects and processes data. Valves 3,5,6, and 7 are used to measure speed of sound in the coiled tubing 1 which is shown foreshortened. Valve 6 could be an electrically operated valve number 71215SN2KV00N0C111C1 made by Honeywell/Skinner Co. of New Britain, Conn. The coiled tubing may for, example, comprise 150 feet of ⅜ inch diameter stainless steel tubing formed in a coil of approximately 2 feet in diameter. While stainless steel tubing is preferable, other materials such as copper or steel may also be used and the diameter and length may be varied, although at least 150 feet should be used.

The process begins by measuring the speed of sound in the gaseous material in the casing. With all valves closed except 3, 5 and 7, gas from the casing is allowed to fill the coiled tubing. Valve 3 is then closed and the pressure in the coiled tubing increases to that of the casing gas. Valve 5 is then closed thereby trapping the sample gas in the coiled tubing. With the computer and sampling equipment operating, valve 6 is briefly opened and closed to cause a rarefaction pressure wave to travel through the coiled tubing to the closed valve 3 and return. The round trip time is measured and speed of sound is calculated at prevailing pressure and temperature in the coiled tubing using the formula $$V_t=2\ L_t/T_t \qquad \ldots 4$$

where $L_t$=linear length of the coiled tubing, ft $T_t$=round trip time of the rarefaction pressure wave induced into the coiled tubing, sec.

Typical measurements might be $L_t$=150 ft $T_t$=0.273 sec $V_t$=2 (150)/0.273=1099 ft/sec.

Next in the process is determination of fluid level in the well. All valves except valve 9 are closed. With the computer and sampling equipment operating, valve 6 is briefly opened and closed to cause a rarefaction pressure wave to travel down the casing—tubing annulus to the top of the fluid and return to the surface. The computer determines the round trip time for the pressure wave and computes the fluid level from $$H=0.5\ V_c\ T$$

where

H=distance from the surface to the fluid level, ft $V_c$=previously measured velocity of sound suitably adjusted to downhole pressure and temperature, ft/sec $T_f$=round trip time for the rarefaction disturbance to travel to the fluid level and return, sec.

Typical measurements might be $T_f$=13.254 sec $V_c$=1075 ft/sec

H=0.5 (1075) (13.254)=7124 ft from surface.

It is known that the velocity of sound in gas (i.e. the speed of the induced wave) varies with temperature and pressure. Further it is known that temperature and pressure vary within the casing-tubing annulus. Thus a refinement of the process described herein would be to consider the change of speed and its effect on round trip time of the pressure wave traveling within the annulus. From direct measurements, oil producers can determine the temperature of the gas entering the well from the reservoir. Temperature of the gas leaving the well at the surface can also be measured. Thus it is possible to make estimates of temperature at various depths in the annulus knowing entering and exiting temperatures. Further the pressure of the gas leaving the well at the surface can be measured. From this and the estimated temperature variation in the annulus, the pressure of the gas at various depths can be calculated from known laws of physics and inferred gas gravity. The procedure is to estimate average temperature and pressure in several depth intervals in the annulus. Then the average speeds of sound are calculated from gas gravity (inferred from measured speed in the coiled tubing experiment) and estimated temperature and pressure in the various annulus intervals. The depth to the fluid level is then obtained with more precision by considering that the speed of the induced pressure wave varies with depth.

Figure 3:
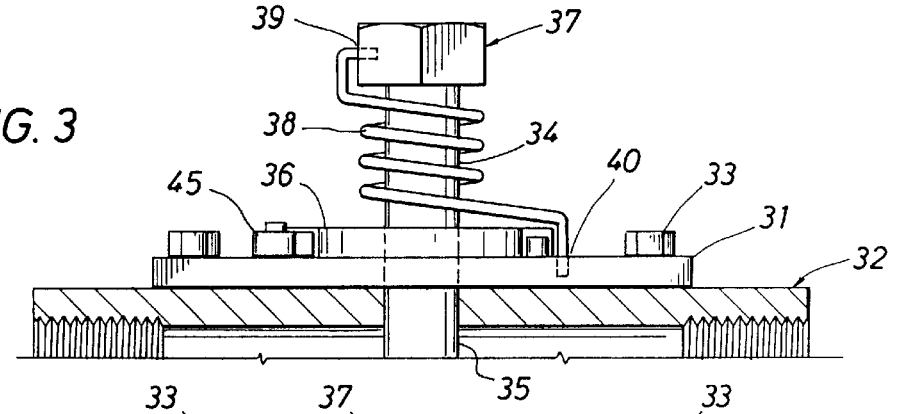
FIG. 3 is a side view of a quick acting mechanical valve suitable for venting gas from the casing or introducing high pressure gas into the casing.
Figure 4:
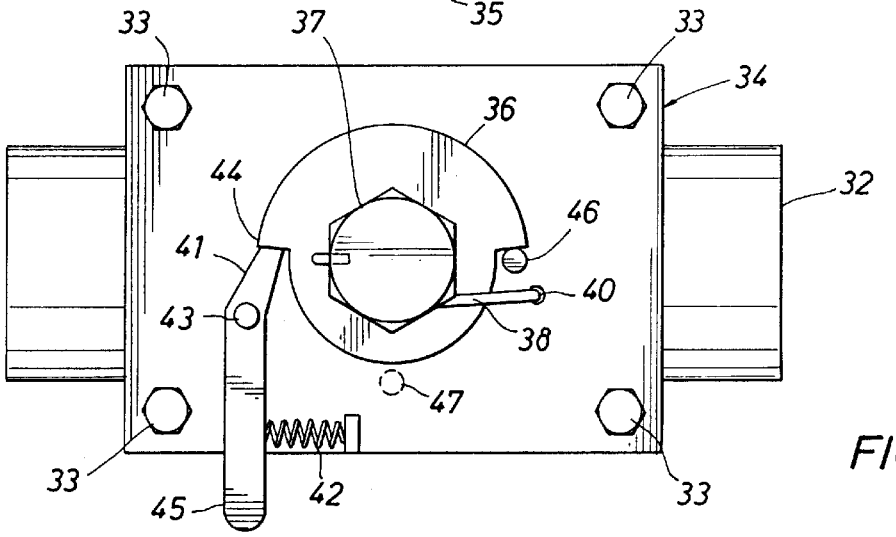
FIG. 4 is a top view of the quick acting valve shown in FIG. 3.

The quick opening valve 8 which vents gas to create the pressure disturbance can be electrically or mechanically operated. Any type of valve may be used providing it can move from a closed position to an open position and return to a closed position in a short time interval. The time interval is on the order of a half second or less to insure the production of a sharp pressure pulse. Electrically operated solonoid valves made by Honeywell/Skinner have been previously described. Referring to FIG. 3 and 4 there is disclosed a mechanical valve being comprised of a mounting plate 31 which is attached to the valve body 32 with mounting bolts 33. The support shaft 34 is attached to the valve stem 35. A cam plate 36 and cocking nut 37 are firmly secured to the support shaft. A torsion spring 38 is installed around the support shaft with one end of the spring being anchored in hole 40 in the base plate. The device is cocked by applying a torque to the cocking nut with a common wrench. As the cocking nut is turned, the support shaft, cam plate and valve stem rotate as a unit to tighten and store energy in the torsional spring. When fully cocked, the trigger lever paw 41 is driven by the compression spring 42 around pivot pin 43 and engages cam shoulder 44 which locks the cam plate. To operate the valve, a small force is applied to the trigger lever arm 45. The force can be applied manually or electrically using a solenoid. When the paw is disengaged from the cam shoulder, the mechanism abruptly rotates the cam and valve stem using stored energy until the cam shoulder contacts the stop pin 46. During the operation, the valve ball or plug is rotated 180 degrees which emits the gas by opening and then closing the valve.

Another method of using this valve is to install the stop pin in hole 47 in the mounting plate. This change permits 90 degree rotation of the valve instead of 180 degree rotation. The valve operates from a closed position when cocked to a full open position after triggering. The procedure is used to release compressed gas (carbon dioxide, nitrogen, air, etc.) from a chamber into the casing annulus for determining an echo from the top of the fluid.

The present invention also relates to pump-off control of a well. Information needed to make a control decision usually travels to the surface through the same medium as that used to transmit energy from the surface to the downhole pump. In the vast majority of cases, pump off controls are applied to wells being lifted with sucker rod equipment. Thus downhole information is transmitted to the surface via the sucker rods. Most pump off controllers are based on dynamometer cards either at the surface or at the downhole pump wherein said cards are computed from surface data. In some cases, unanticipated downhole conditions can confuse the data traveling to the surface on which pump off decisions are made. For example if a rod pumped well develops a severe downhole friction problem, the data which traveled to the surface via the sucker rod would be altered and perhaps would be rendered useless in making a pump off decision. In addition the stator of a progressive cavity pump being actuated with sucker rods might harden because of hydrogen sulfide attack and the resulting change in friction might confuse a pump off controller which is deriving its intelligence via the drive train.

Figure 5:
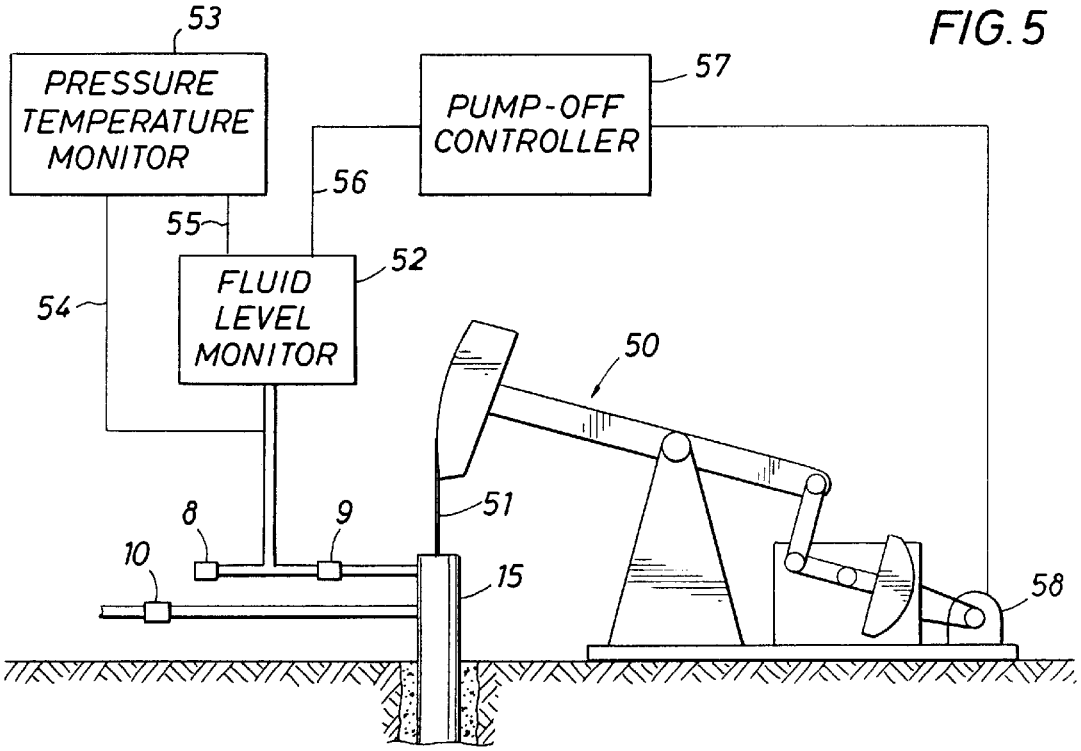
FIG. 5 shows how the present invention could be used to perform pump off control.

Referring to FIG. 5 there is shown an apparatus for controlling the production from a well using the fluid levels determined by the present invention. A portion of the well structure of FIG. 1 is shown with the addition of a pumping unit 50. The pumping unit is a conventional rod pumping unit that reciprocates the rod string 51 to actuate a downhole pump (not shown). The production from the downhole pump is removed from the production tubing 16 of FIG. 1 through a line not shown in FIG. 5. The gas from the annulus between the well casing and production tubing string is removed through a suitable production line with the flow controlled by the valve 10 of FIG. 1.

The fluid level monitor 52 includes the monitoring apparatus described above with reference to FIG. 1. In addition to the fluid level monitor 52 there is shown a pressure and temperature monitor 53. The monitor 53 samples the gas in the annulus through a line 54 and supplies an electrical signal 55 to fluid level monitor 52. The electrical signal may be either analog or digital. The pressure and temperature monitor utilizes commercially available components that measure pressure and temperatures and supply related electrical signals. The temperature and pressure measurements are used to compute the temperature and pressure at a selected depth in the well. The computed temperature and pressure are used to adjust the velocity measured as described above for the selected depth in the well.

The fluid level monitor measures the fluid level in the well at preset times that can be controlled by a clock. The measured fluid levels are supplied as an electrical signal 56 to the pump-off controller 57. The pump-off controller utilizes the fluid level measurements to start and stop the pumping unit 50. As shown the pumping unit utilizes an electric motor that can be controlled by controlling the power to the motor. Alternatively, instead of starting and stopping the motor 58 its speed can be controlled to vary the rate of pumping the well. Regardless of the method used for controlling pumping rate the fluid level is maintained between preset limits that are set by the operator.

While the present invention has described the venting of casing gas to produce pressure pulses other means may be used. When environmental considerations require the pressure pulse may be created by releasing pressurized gas into the casing. The pressure pulse in the coiled tubing can also be created by the release of pressurized gas into the coiled tubing. Normally the amount of gas vented from the coiled tubing is small, i.e. less than 0.1 standard cubic feet and does not create an environmental problem. The velocity of sound in the casing gas is only measured at infrequent intervals, for example, once for each well test. This further reduces the gas that is vented.

An advantage of the present invention is that gas in the casing constitutes a large (nearly unlimited) supply of energy for creating the pressure wave and monitoring fluid level on a continuous basis. Should pump off control be accomplished with traditional fluid level methods, a large quantity of compressed gas would have to be supplied and replenished as necessary to create the loud noise necessary to measure velocity and fluid level. Thus the present invention has an advantage in that the pressure waves are created with casing gas which is replenished during normal production operations. Under timer or computer control, the quick acting valve 8 can be caused to repetitively sense fluid level. When the fluid level 19 is close to the downhole pump the pump off controller can stop the pumping unit. In stopping the unit, lifting energy is saved and wear and tear on the artificial lift equipment is diminished. After a preset resting period, the controller can start the pumping unit again and repeat the process. A disadvantage of conventional pump off controllers is that the resting period must be set by trial and error. The present invention could be taught to resume pumping, not after a preset time has elapsed, but after the fluid level has risen sufficiently. Another variation would be to slow the rate of pumping rather than stopping it entirely. This would be advantageous in wells which produce sand which tends to fall back and stick the pump when pumping is stopped entirely. Should fluid level 19 be sufficiently close to the surface, the controller could instruct the pumping equipment to continue operating. A variation would be to instruct the pumping equipment to pump faster thereby increasing production and income from the well.

What I claim is:

1. A method of controlling the production cycle of a well having means for artificially lifting fluid to the surface, said well in addition having a casing and a production tubing disposed within the casing, the annulus between the casing and the tubing being filled with a gas at the top and fluid at the bottom, said method comprising:

determining the velocity of sound in the gas by filling an external container with gas from the well and measuring the velocity of sound in the gas filled external container, measuring the travel time of a sound pulse from the surface of the well to the fluid level and return to the surface;

converting the measured travel time to depth of the fluid using the measured velocity of sound; and utilizing the depth of fluid to control the production cycle of the well.

2. The method of claim 1 and in addition repeatedly measuring the fluid level at preset intervals.

3. The method of claim 2 wherein the measured fluid levels are compared to preset limits to determine if pumping rate should be increased or decreased.

4. The method of claim 3 wherein the pumping rate is controlled by starting and stopping the artificial lift means.

* * * * *